US005446240A

United States Patent [19]

Hayakawa et al.

[11] Patent Number: 5,446,240

[45] Date of Patent: Aug. 29, 1995

[54] MAGNETIC DISK SYSTEM HAVING FLEXIBLE PRINT CABLE FOR MAGNETIC HEAD AND METHOD OF ASSEMBLING THE SAME

[75] Inventors: Yuichi Hayakawa, Tokyo; Yoshimasa Hoshino; Makoto Nakayama, both of Gunma, all of Japan

[73] Assignee: NEC Corporation, Tokyo, Japan

[21] Appl. No.: 14,416

[22] Filed: Feb. 5, 1993

[30] Foreign Application Priority Data

Mar. 2, 1992 [JP] Japan ..... 4-044267

[51] Int. Cl.[6] ..... H01B 7/04

[52] U.S. Cl. ..... 174/69; 174/72 TR; 360/137

[58] Field of Search ..... 174/69, 72 TR; 360/97.01, 97.02, 106, 137; 400/692

[56] References Cited

U.S. PATENT DOCUMENTS 4,599,666 7/1986 Liu et al. ..... 360/97.01 X 4,992,684 2/1991 Matsui ..... 360/106 X

OTHER PUBLICATIONS

Dunman et al., Actuator Assembly for a Disk File, Oct. 1977, pp. 1984–1985, IBM Technical Disclosure Bulletin.

*Primary Examiner*—Leo P. Picard

*Assistant Examiner*—Hyung S. Sough

*Attorney, Agent, or Firm*—Foley & Lardner

[57] ABSTRACT

End faces of the opposite ends of an FPC for connecting a movable magnetic head and a stationary electric circuit to each other are supported parallel to the plane of a recording medium and in the substantially same plane. The height of the FPC when it is flexed and twisted can be further reduced by forming a slot or slots longitudinally in the FPC and/or by forming a repeat or repeats of an S shape on the FPC. The height of the FPC upon flexing and twisting can be further reduced by bending the opposite side portions of an intermediate portion of the FPC between the end faces longitudinally. If the vertical spacing of the FPC which is flexed by movement of the magnetic head is reduced in this manner, a device of miniaturized thickness and volume can be constructed.

9 Claims, 6 Drawing Sheets

MAGNETIC DISK SYSTEM HAVING FLEXIBLE PRINT CABLE FOR MAGNETIC HEAD AND METHOD OF ASSEMBLING THE SAME

BACKGROUND OF THE INVENTION

1. Field of the Invention

This invention relates generally to a flexible print cable for a magnetic head and to a method of assembling the same, and particularly to a flat flexible print cable (hereinafter referred to as FPC) which electrically connects the magnetic head of a floppy disk device or like device, which moves along the plane of a flat record medium, to a stationary electric circuit, and to a method of assembling the FPC.

2. Description of the Related Art

As shown in FIG. 1, conventional FPC 2 of the type mentioned extends in a plane perpendicular to the plane of recording medium 3. When magnetic head 1 moves to the inner or outer circumferential track of recording medium 3 as indicated by arrow A, FPC 2 having fixed width W is flexed while keeping the plane thereof perpendicular to interconnect between magnetic head 1 and an electric circuit (not shown). In the arrangement shown in FIG. 1, both end face 4 of FPC 2 on the magnetic head side and end face 5 on the electric circuit side are supported perpendicular to the plane of recording medium 3.

FIG. 2 shows another example of the prior art. End face 14 of FPC 12 on magnetic head 1 side and end face 15 of the electric circuit side are supported, different from the arrangement of FIG. 1, parallel to the plane of recording medium 3. However, the two end faces 14 and 15 are not included in the same plane, but are disposed in two parallel planes separated by distance D, and when magnetic head 1 moves, FPC 12 is flexed while the entire plane thereof remains parallel.

As notebook type personal computers and like devices have rapidly come into use in recent years, miniaturization of floppy disk devices mounted on these devices has become indispensable. Above all, since an FPC for a magnetic head is restricted in its spacing for flexure motion, width W in FIG. 1 and distance D in FIG. 2 must be minimized. In particular, it is sometimes necessary to restrict width W of the FPC equal to or less than 2 mm, and in this instance, there is the problem that a predetermined number of signal patterns cannot be assured. Also the arrangement of FIG. 2 has a drawback in that, when distance D is restricted equal to or less than 2 mm, the durability of the FPC against flexure is reduced.

SUMMARY OF THE INVENTION

It is an object of the present invention to provide an FPC for a magnetic head, which can be flexed smoothly in a space limited vertically and has long durability against flexure in order to allow realization of a floppy disk device of small overall thickness and volume, and to provide a method of assembling the FPC.

Thus, the assembly method for an FPC for the magnetic head of the present invention is characterized in that one end face of the cable on the magnetic head side is supported parallel to the plane of the recording medium, and the other end face of the cable on the electric circuit side is supported parallel to and substantially in the same plane as the end face of the cable on the magnetic head side.

The FPC for the magnetic head of the present invention is so shaped as to be adapted for use with the present assembly method.

Further, according to an embodiment of the FPC for the magnetic head of the present invention, the cable has at least one slot formed longitudinally at an intermediate portion thereof between the end face on the magnetic head side and the end face on the electric circuit side. With this construction, vertical twisting of the cable caused by movement of the magnetic head can be reduced.

According to another embodiment of the FPC in accordance with the present invention, the cable has, at an intermediate portion between the end face on the magnetic head and the end face on the electric circuit side, at least one curved portion formed in an S shape. With this construction, vertical twisting of the cable caused by movement of the magnetic head can be restricted. Further, where the cable has at least one slot formed longitudinally at the intermediate portion thereof, twisting of the cable can be further restricted.

According to a further embodiment of the FPC in accordance with the present invention, one intermediate portion or each of a plurality of intermediate portions, which are divided laterally from each other, of the cable between the end face on the magnetic head side and the end face on the electric circuit side is so shaped that it is folded, at the opposite side portions except a central portion thereof, perpendicular to the plane of the recording medium. With this construction, twisting of the cable can be eliminated.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Embodiments of the present invention are described below with reference to the accompanying drawings.

Figure 1:
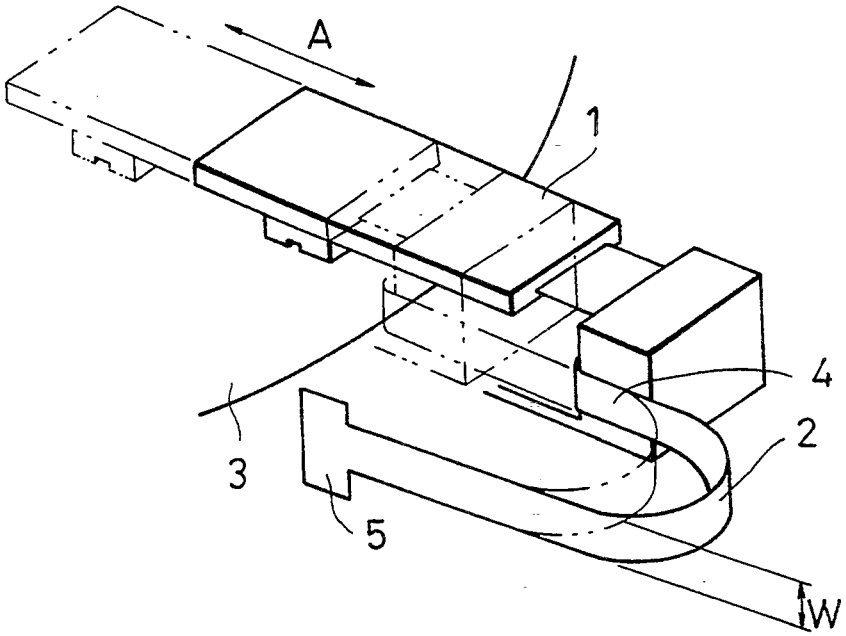
FIG. 1 (PRIOR ART)
FIG. 1 is a schematic perspective view illustrating a conventional example of a method of assembling an FPC for a magnetic head.
Figure 2:
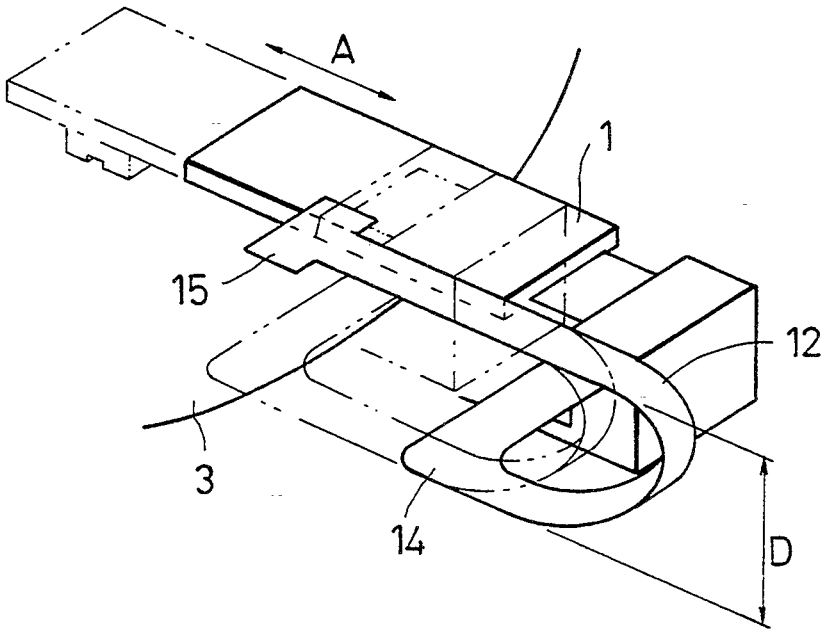
FIG. 2 (PRIOR ART)
FIG. 2 is a schematic perspective view illustrating another conventional example of a method of assembling an FPC for a magnetic head.
Figure 3:
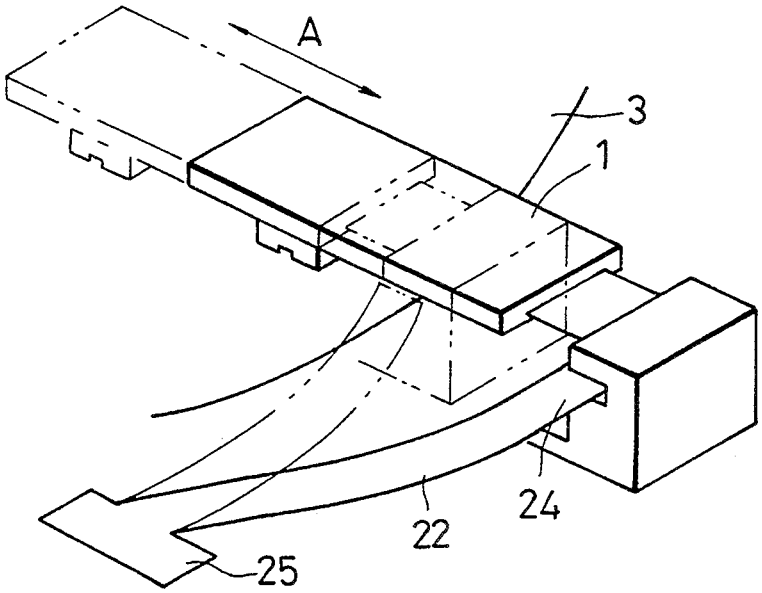
FIG. 3 is a schematic perspective view showing a first embodiment of the present invention.

FIG. 3 is a perspective view showing a first embodiment of the present invention and illustrates a method of assembling magnetic head 1, which moves in the direction indicated by arrow A parallel to the plane of recording medium 3 from the innermost circumferential track to the outermost circumferential track of recording medium 3, and FPC 22 for electrically connecting magnetic head 1 to a stationary electric circuit (not shown). End face 24 of FPC 22 on the magnetic head side and other end face 25 of FPC 22 on the electric circuit side are supported parallel to the plane of recording medium 3. Further, end faces 24 and 25 lie substantially in the same plane. End face 25 is spaced a distance from the line of motion of magnetic head 1. Consequently, although the entire FPC 22 is twisted a little into a twisted condition when magnetic head 1 moves, the function of following up magnetic head 1 is assured.

Figure 4A:
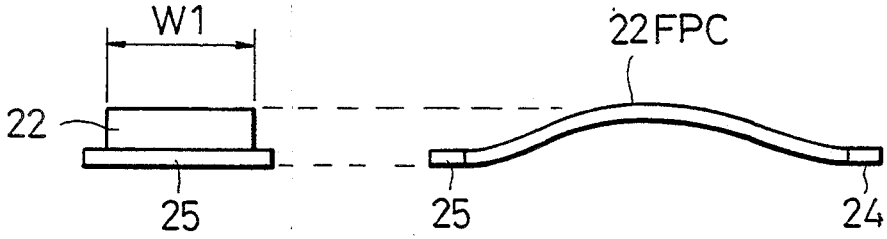
FIGS. 4(*a*) and 4(*b*) are schematic views showing the shapes of FPC 22 initially as viewed longitudinally and laterally and as viewed in the same directions upon flexure motion, respectively, when magnetic head 1 shown in FIG. 3 moves.
Figure 4B:
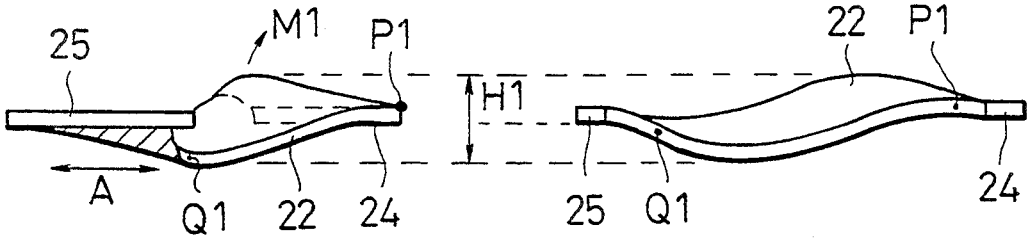

FIG. 4(*a*) shows the shapes of FPC 22 initially as viewed longitudinally and laterally and FIG. 4(*b*) shows the shapes of FPC 22 when it is flexed. While FPC 22 requires a spacing of height H1 upon flexure, height H1 can be made smaller than width W1. The repulsive force of FPC 22 in a flexed condition is concentrated upon the outer and inner edge portions of the flexed portions of FPC 22 in the proximity of end faces 24 and 25, and acts as a tensile force at point P1 of the outer edge portion and as a compressive force at point Q1 on the inside of FPC 22. The internal stresses increase as width W1 increases, and moment M1 is produced due to the difference therebetween and flexes FPC 22 vertically.

Vertical spacing H1 when FPC 22 is flexed presents its maximum magnitude when FPC 22 is twisted its maximum amount, and the spacing can be made smaller than that of the conventional arrangement wherein the FPC is disposed perpendicular to the plane of the recording medium.

Figure 5:
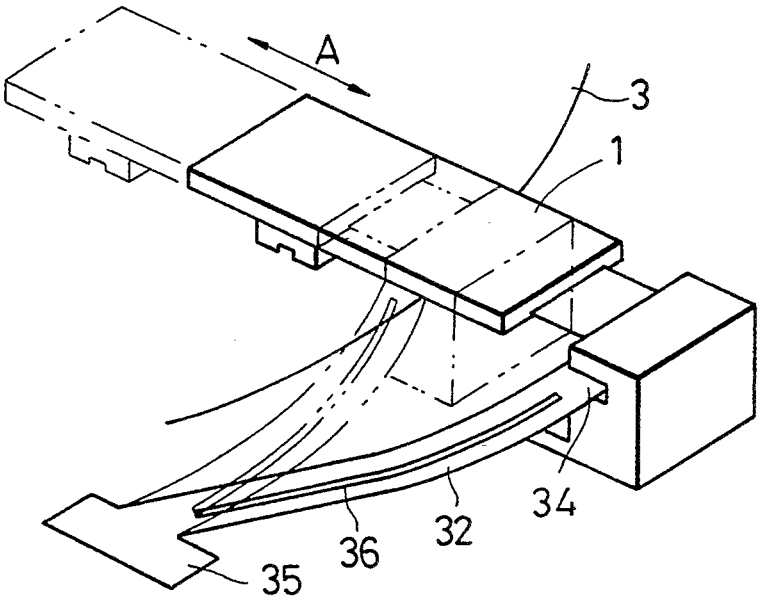
FIG. 5 is a schematic perspective view showing a second embodiment of the present invention.
Figure 6A:
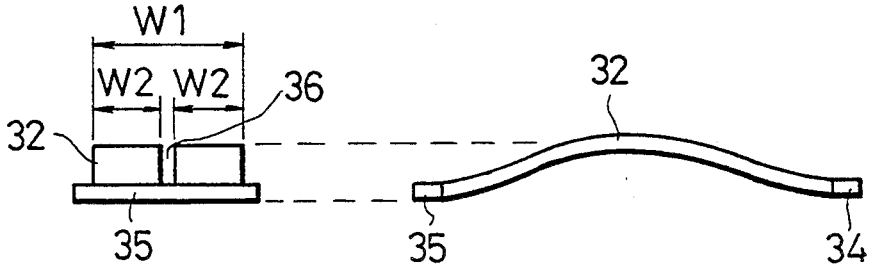
FIGS. 6(*a*) and 6(*b*) are schematic views showing the shapes of FPC 32 initially as viewed longitudinally and laterally and as viewed in the same directions upon flexure motion, respectively, when magnetic head 1 shown FIG. 5 moves.
Figure 6B:
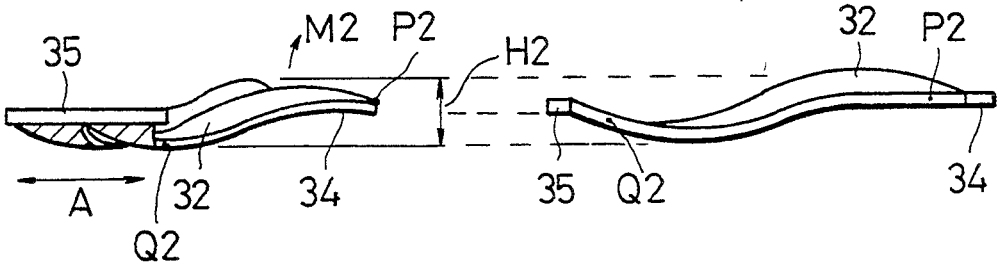

FIG. 5 is a schematic perspective view showing a second embodiment of the present invention. FPC 32 has slot 36 formed longitudinally therein and has end surfaces 34 and 35. Since slot 36 is provided, when FPC 32 is twisted upon movement of magnetic head 1 in the direction indicated by arrow A, it is twisted for each portion of width W2 which is about one half entire width W1 of FPC 32; and accordingly, twisted height H2 of FPC 32 can be reduced to about one half height H1 in FIG. 4(*b*), as shown in FIGS. 6(*a*) and 6(*b*). Simultaneously, the repulsive force of FPC 32 which is applied to point P2 of the outer edge portion and point Q2 of the inner edge portion of the flexed portion of FPC 32 by moment M2 can be further reduced compared with that of FIG. 3. Consequently, the driving torque of a motor (not shown) for feeding magnetic head 1 can also be further reduced.

Figure 7:
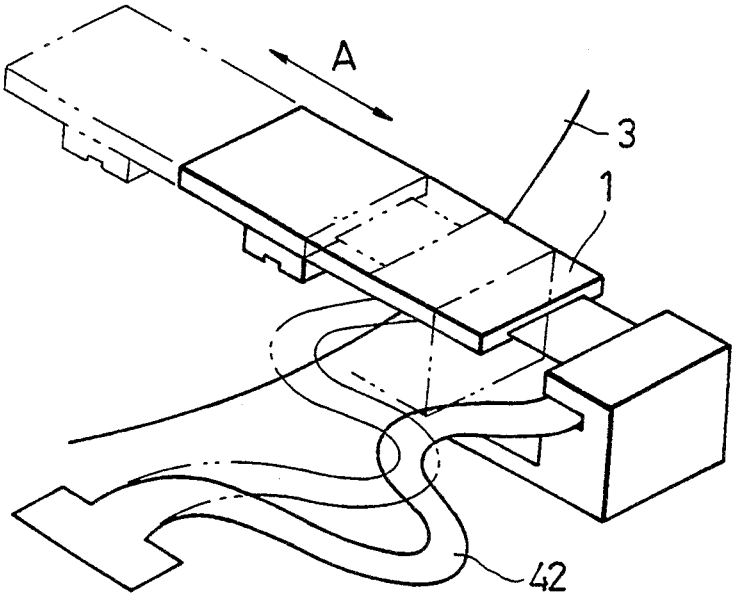
FIG. 7 is a schematic perspective view showing a third embodiment of the present invention.
Figure 8A:
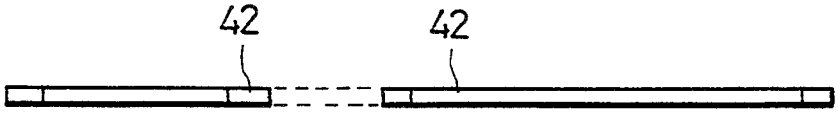
FIGS. 8(*a*) and 8(*b*) are schematic views showing the shapes of FPC 42 initially as viewed longitudinally and laterally and as viewed in the same directions upon flexure motion, respectively, when magnetic head 1 shown FIG. 7 moves.
Figure 8B:
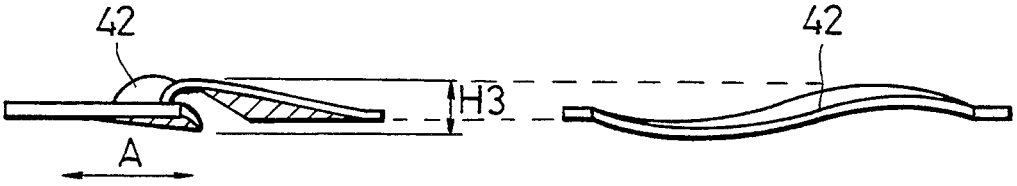

FIG. 7 is a schematic perspective view showing a third embodiment of the present invention and shows a modification to FPC 22 which has a configuration having a repeat or repeats of an S-shaped curve. It should be noted that, in FIG. 7, the number of repeats of the S-shaped curve is shown as one for simplification. With this construction, twisting of FPC 42 upon movement of magnetic head 1 in the direction indicated by arrow A can be moderated and height H3 of FPC 42 upon twisting can also be kept low as shown in FIGS. 8(*a*) and 8(*b*). Consequently, the spacing for FPC 42 upon twisting motion can also be made low. Also, the driving torque of the motor can be further reduced.

Figure 9:
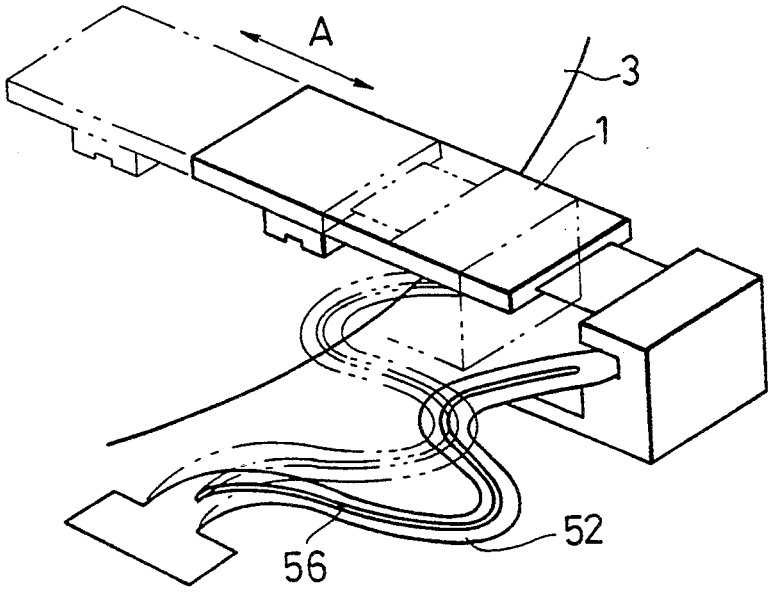
FIG. 9 is a schematic perspective view showing a fourth embodiment of the present invention.

FIG. 9 is a schematic perspective view showing a fourth embodiment of the present invention and shows a modification to FPC 42 of FIG. 7 which has a slot 56 formed longitudinally therein. With this construction, the height of FPC 52 upon twisting and the driving torque of the motor can both be further reduced as in the embodiment of FIG. 5.

It should be noted that slot 36 in FIG. 5 or slot 56 in FIG. 9 may be provided not singly but in a plurality in order to enhance the effect described above. Further, with regard to FPC 42 of FIG. 7 or FPC 52 of FIG. 9, since it is formed in an S-shape curve to increase the overall length thereof, it can be made flat without the necessity of initially assuring a marginal length for flexing for the length thereof, and if it is held forcibly from above and below by guides or like means, the height upon flexure can be further reduced.

Figure 10A:
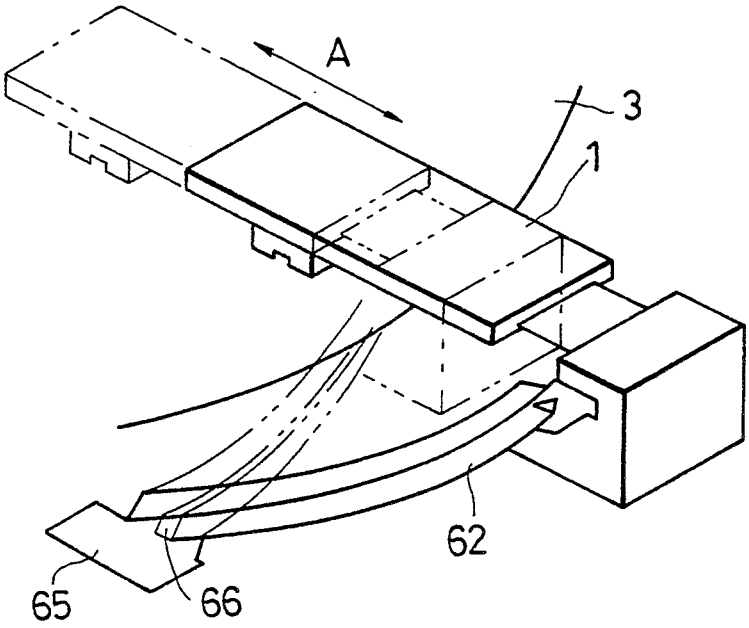
FIG. 10(*a*) is a schematic perspective view showing a fifth embodiment of the present invention, while FIG. 10(*b*) is a partial developed view of the FPC of FIG. 10(*a*).
Figure 10B:
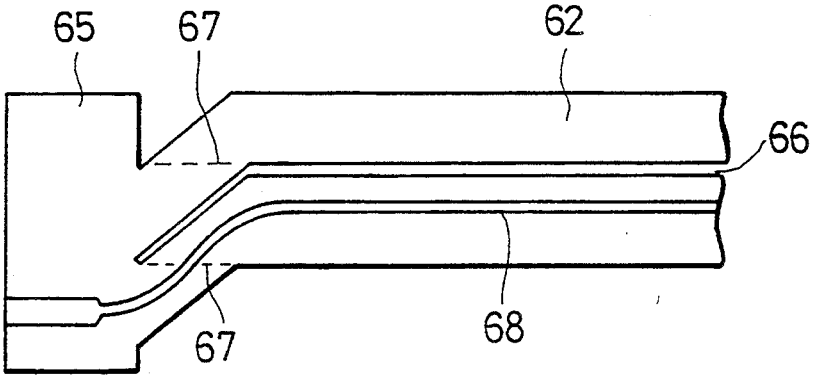

FIG. 10(*a*) is a schematic perspective view showing a fifth embodiment of the present invention, while FIG. 10(*b*) is a partial developed view of FPC 62. The longitudinal portion of FPC 62 is so shaped as to be coupled obliquely to end face 65, and wiring pattern 68 and slot 66 are provided to conform with the shape of the longitudinal portion. Portions of FPC 62 separated by slot 66 are bent at the positions of folds 67 thereof perpendicular to the plane of recording medium 3. With this construction, twisting of the FPC, which is caused in the embodiments of FIGS. 3 to 9, is eliminated, further, the vertical spacing in which FPC 62 is flexed can also be reduced to about one half that of the prior art. It should be noted that the slot may otherwise be provided in a plurality so that the vertical spacing may be further reduced.

As described so far, according to the present invention, since the opposite end faces of a flexible print cable (FPC) are supported parallel to the plane of the recording medium and substantially in the same plane, the vertical spacing in which the FPC is flexed can be reduced. Further, by forming a slot or slots in the FPC or by some other suitable means, twisting of the FPC can be reduced or eliminated so that it will not have an influence on the driving torque of a motor for feeding the magnetic head. Accordingly, recent miniaturization of floppy disk devices or like devices can be further developed.

Although certain preferred embodiments of the present invention have been shown and described in detail, it should be understood that various changes and modifications may be made therein without departing from the scope of the present invention.

What is claimed is:

1. A magnetic disk system, comprising:

a magnetic head movable along a line of motion in a plane of a recording medium;

a stationary electric circuit; and a flexible print cable for electrically connecting the magnetic head to the stationary electric circuit, and having a first end face at the magnetic head and a second end face at the stationary electric circuit;

wherein the first end face is supported in a plane parallel to the plane of the recording medium and wherein the second end face is supported parallel to and in substantially the same plane as the first end face; and further wherein the second end face is spaced a distance from the line of motion of the magnetic head in a perpendicular direction to said line of motion of said magnetic head.

2. A magnetic disk system as claimed in claim 1, wherein said cable has at least one slot formed longitudinally at an intermediate portion thereof between said first end face and said second end face.

3. A magnetic disk system as claimed in claim 1, wherein said cable has, at an intermediate portion between said first end face and said second end face, at least one curved portion formed in an S shape.

4. A magnetic disk system as claimed in claim 3, wherein said cable has at least one slot formed longitudinally at said intermediate portion thereof between said first end face and said second end face.

5. A magnetic disk system as claimed in claim 1, wherein one intermediate portion or each of a plurality of intermediate portions which are divided laterally from each other, of said cable between said first end face and said second end face is perpendicular to the plane of the recording medium.

6. A magnetic disk system as claimed in claim 2, wherein, one intermediate portion or each of a plurality of intermediate portions which are divided laterally from each other, of said cable between said first end face and said second end face is perpendicular to the plane of the recording medium.

7. A magnetic disk system as claimed in claim 3, wherein one intermediate portion or each of a plurality of intermediate portions which are divided laterally from each other, of said cable between said first end face and said second end face is perpendicular to the plane of the recording medium.

8. A magnetic disk system as claimed in claim 4, wherein one intermediate portion or each of a plurality of intermediate portions which are divided laterally from each other, of said cable between said first end face and said second end face is perpendicular to the plane of the recording medium.

9. An assembly method for a flexible print cable for electrically connecting the magnetic head of a magnetic disk device, which moves along the plane of a flat recording medium, to a stationary electric circuit, comprising the steps of:

supporting one end face of said cable on said magnetic head side parallel to the plane of the recording medium;

supporting the other end face of said cable on said electric circuit side parallel to and substantially in the same plane as said end face of said cable on said magnetic head side; and spacing said end face on said electric circuit side a distance from a line of motion of said magnetic head in a perpendicular direction to said line of motion of said magnetic head.

* * * * *